United States Patent [19]

Plevyak et al.

[11] Patent Number: 4,497,488

[45] Date of Patent: Feb. 5, 1985

[54] COMPUTERIZED CARD SHUFFLING MACHINE

[76] Inventors: Jerome B. Plevyak, 200 N. Faklanding Rd., Maple Shade, N.J. 08052; Adolph E. Nicoletti, 8 Villano Ct., Berlin, N.J. 08009

[21] Appl. No.: 438,408

[22] Filed: Nov. 1, 1982

[51] Int. Cl.[3] ..... A63F 1/12

[52] U.S. Cl. ..... 273/149 R

[58] Field of Search ..... 273/149 R; 270/58

[56] References Cited

U.S. PATENT DOCUMENTS

| | | | |
|---|---|---|---|
| 2,922,893 | 1/1960 | Ett | 67/286 X |
| 3,045,364 | 7/1962 | Surber | 64/267 X |
| 3,222,071 | 12/1965 | Lang | 273/149 R |
| 3,232,622 | 2/1966 | Lambert | 273/149 R |
| 3,575,408 | 4/1971 | Cole | 270/58 |
| 3,588,116 | 6/1971 | Miura | 273/149 R |
| 3,589,730 | 6/1971 | Slay | 273/149 R |
| 3,897,954 | 8/1975 | Erickson | 273/149 R |
| 3,929,339 | 12/1975 | Mattioli | 273/149 R |
| 4,023,010 | 5/1977 | Horst et al. | 64/449 X |
| 4,033,590 | 7/1977 | Pic | 273/149 R |
| 4,041,279 | 8/1977 | Foote | 235/61.7 |
| 4,072,304 | 2/1978 | Brown et al. | 270/58 |
| 4,099,810 | 7/1978 | Stange | 270/58 |
| 4,132,351 | 1/1979 | Sakurai et al. | 235/454 |
| 4,145,038 | 3/1979 | Mol | 270/58 |
| 4,310,160 | 1/1982 | Willette et al. | 273/149 R |

*Primary Examiner*—Richard C. Pinkham
*Assistant Examiner*—Leo P. Picard
*Attorney, Agent, or Firm*—William T. Hough

[57] ABSTRACT

A computerized card shuffling machine having major portions of transparent wall making cards being shuffled at all times viewable externally, including an input shoe for holding cards to be shuffled and to be fed to a revolving wheel having a plurality of receiving positions, and including an output shoe receivable of cards fed from the plurality, mechanism for randomly matching ones individually of the plurality with the input shoe during an input cycle and with the output shoe during an output cycle, mechanism for feeding cards from the input shoe to matched ones of the plurality and from ones of the plurality to the output shoe, mechanism for selecting for any single cycle how many of the plurality shall be utilized and in what matching order, and the mechanism being for a random selection within predetermined limits, the plurality being sixteen positions inclusive of at-least one sixteen-position matching sequence of 3-4-6-3, and a matching timer mechanism inclusive of a light beam producing photoelectric cell light and a light-receiving photoelectric cell connected with a computer such that timing of the wheel matching of the shoes with individual ones of the plurality is affected in proper alignment and in accord with a computer-chosen computer matching order and for initiating consecutive sequences.

37 Claims, 8 Drawing Figures

COMPUTERIZED CARD SHUFFLING MACHINE

BACKGROUND TO THE INVENTION

Prior to the present invention casinos have been confronted with a major and costly problem in the game of black-jack, of losing considerable amounts of money to persons known as card-counters who keep a mathematical account of which cards have been thus-far played and the mathematical probabilities of for example beating the dealer by obtaining five cards totaling less than value 21, or by obtaining a card combination close to 21 but not exceeding it, or by obtaining a card combination known as "black-jack". Whenever a card-counter is present, other players are quick to become aware of him and follow his betting and playing tactics to thereby also increase significantly their winnings at the great expense of the "house" represented by the dealer. To partially counter such major advantage achievable by card counters, the dealers have resorted to playing with a combination of several decks up to about eight decks shuffled-together, for a single game or partial-game of dealings for the game of black-jack, to thereby decrease the ability of the card-counter to rapidly arrive at any major advantage during earlier phases of a black-jack game.

However, other considerations have also prompted and led to the present invention, such as the inventors' recognition that in order for the card-counters to effectively operated—particularly as multiple decks are employed, sufficient time for accounting and mathematical computations is necessary such as the time between consecutive dealings. But of even greater importance, the inventors observed that between consecutive shufflings of cards there is a time interval of about eleven minutes, of which the card-shuffling consumes about three minutes possibly—which amounts to as much as 27 percent of total playing time, or conservatively at least 20 loss of potential earning as compared to no loss of time during the shuffling procedure, such loss amounting to about ten to fifteen million dollars per year, particularly when taken with losses incurred as a result of the card-counters. by eliminating these downtimes and making easier the job of the dealer, considerable savings as against losses to card-counters, and improved profits from increased playing time could be achieved. Also, by a novel shuffling machine obtaining improved random mixing of cards and more quickly obtained, predictability by card-counters of probabilities is substantially decreased.

OBJECTS OF THE INVENTION

Accordingly, objects of the invention include the overcoming of problems and difficulties of dealers for the game of black-jack, of the type noted-above.

Another object is to obtain a card-shuffling machine of a small size compatible with the casino typical small group of dealer and seven players per table.

Another object is to obtain a card-shuffling machine devoid of any significant vibrations or shocks of starting and stopping and the like—which could be distracting or interfere with continued simultaneous playing with other decks on the table.

Another object is to obtain a card-shuffling machine capable of shuffling up to about eight decks within a very short time period such as about one minute or less.

Another object is to obtain a card-shuffling machine in which the cards being shuffled are at all times visible to the players.

Another object is to obtain a card-shuffling machine that is substantially devoid of any operational noise that could be either distracting or an irritant.

Another object is to obtain a card-shuffling machine that is utilizable and operatable devoid of significant nor great amount of attention or work on the part of the dealer, and that does not require any operator apart from the dealer, during the normal course of dealing and playing hands of black-jack.

Another object is to obtain a card-shuffling machine that is mountable on or at the edge of the black-jack table in full view of the players.

Another major and main object is to obtain a card-shuffling machine that beyond predictability by the greatest mathematition, intermixes cards of a deck or composite of decks thoroughly and randomly.

Another object is to include computer preprogrammed random choices of feeding cards during one or more of several sequences of different orders of shuffling distribution per shuffling of cards, such that randomly-selected orders are orders of a high degree of intermixing of cards of a deck or decks to be shuffled.

Another object is to obtain a card-shuffling machine having separate input-card-holding shoe and output-shuffled-card-holding shoe.

Another object is to obtain a card-shuffling machine having a predetermined number of shuffling card-receiving positions tailored to a high degree of intermixing of cards while concurrently doing so within a short or abbreviated period of time of shuffling.

Another object is to include computer preprogrammed random choices of choosing which maximum number and which specific shuffling card-receiving positions are to be utilized during a next-occuring sequence of a particular order of positions to be dealt as governed by computer random-choice of available matching arrangements.

Another object is to obtain a card-shuffling machine that shuffles during the initial feed from a feed shoe of cards to be shuffled, and that further again shuffles during return of cards to an output-shuffled-card-holding shoe.

Another object is to obtain a card-shuffling machine employing photoelectric cells and employing solenoids, for improved speed of detection and operation of moving parts.

Another object is to obtain a card-shuffling machine employing a wheel containing shuffling positions to be fed to thereby optimize short shuffling time for shifting between various positions to be fed or fed-from in accord with predetermined matching order of shuffling or reshuffling.

Another object is to employ a perfected arrangement for obtaining speedy and accurate aligning of matched positions for each and every occuring matching and feeding from or to a shoe from a matched position of an existing plurality of positions.

Another object is to obtain a specially-designed shoe having a movable side movable when mounted to thereby provide card-passing space through-which cards may be fed to the shuffling positions and through-which cards may be refed for output holding in the shoe.

Another object is to obtain novel mechanisms for causing cards to feed to and from the shoes, as between the shoes and the wheel shuffling positions.

Other objects become apparent from the preceding and following disclosure.

One or more objects are obtained by the invention as disclosed herein, as typically illustrated for improved understanding, in the accompanying FIGS., but such illustrations not being intended to unduly limit the invention which includes variations within the spirit of the invention as would be apparent to a person of ordinary skill in this particular field.

BROAD DESCRIPTION

In its most broad concept, the invention includes a structure and mechanism that may be designated a card holding and feeding structure and mechanism, and a transfer structure and mechanism that includes a plurality of separate card-receiving, holding and feeding structured stations, i.e. positions, and mechanisms thereof, and shifting structure and mechanism intermittently matchable of different ones of the stations (positions) with (1) the card first-holding and feeding structure containing (containable of) cards to be shuffled, and (2) the receiving shoe for the card-receiving of shuffled cards, for respectively the feeding or return-feed between matched and aligned positions, it being within the scope of the invention that the cards be fed from and the shuffled cards returned to the same position and/or shoe. Preferably there are separate shoes and positions for the feeding of cards to be shuffled and for alternately shuffled card to be output-fed to.

Preferably feeding cycle of cards to be shuffled by the input cycle, and cards-returned cycle returning cards to a shoe, are separate operations. However, they may be run simultaneously.

More particularly, for the input cycle for feeding cards to be shuffled from the unshuffled-card shoe, there is included a mechanism initiatable only when a receiving position is matched and aligned, for causing a card (one or more, as predetermined) to be fed to that matched position, and likewise for the output cycle for refeeding cards from a received-position (that had been earlier matched) to a shuffled-card-holding shoe there is another corresponding mechanism.

For the above-noted plurality of stations (positions) of the card-receiving structure and mechanism, there is provided selection mechanism causing different ones of the plurality to become intermittently matched in a predetermined order of sequence with the card holding and feeding structure in alignment for feeding card(s) therefrom, or for refeeding-output-cards thereto.

There is provided further portions of the selection mechanism designed as computer function to provide intermittently in series different ones of said predetermined order such that order of matching (above-noted) is continually intermittently changing during feeding of the input-cycle and refeeding during the output-cycle.

Also by way of computer programming, there is provided an off-set feed and off-set refeed mechanism employed in conjunction with the computer-selected particular order(s) of matching, such that occasionally and randomly certain ones of the plurality of positions will not be utilized in the count of an order of matching, and the number not utilized varied randomly from time to time.

When during a single sequence the number of positions utilized is sixteen, as differently available positions to be matched with a feed shoe (of the card holding and feeding structure and mechanism), and when all sixteen (or sixteen of available positions are to be utilized in applying a particular order of matching) are to be utilized in applying an order of matching, a preferred order of matching is 3-4-6-3. This means that a first card of this sequence of the next four cards to be dealt, is fed to the next-occuring third position from the last registered (counted) position prior thereto, and thereafter (from the same last-registered (counted) position) to the seventh position, and thereafter to the thirteenth position, and thereafter to the sixteenth position. Thereafter, the computer has designated a new matching order for the next-occuring sequence for the next four cards to be dealt.

When the number of the plurality of positions, or alternately the number of positions (of a larger available number) to be used (as determined by the computer, randomly) is fifteen, a preferred order of matching is 2-3-5-5. This means that, as explained above, a first card is fed to the next-occuring second position, and thereafter to the fifth position, and thereafter to the tenth position, and thereafter to the fifteenth position.

When the number of the plurality of positions, or alternately the number of positions (of a larger available number) to be used (as determined by the computer, randomly) is fourteen, a preferred order of matching is 2-6-3-3. This means that, as explained above, a first card is fed to the next-occuring second position, and thereafter to the eighth position, and thereafter to the eleventh position, and thereafter to the fourteenth position.

When the number of the plurality of positions, or alternately the number of positions (of a larger available number) to be used (as determined by the computer, randomly) is seventeen, a preferred order of matching is 4-3-5-5. This means that, as explained above, a first card is fed to the next-occuring fourth position, and thereafter to the seventh position, and thereafter to the twelth position, and thereafter to the seventeenth position.

When the number of the plurality of positions, or alternately the number of positions (of a larger available number) to be used (as determined by the computer, randomly) is eighteen, a preferred order of matching is 5-3-6-4. This means that, as explained above, a first card is fed to the next-occuring fifth position, and thereafter to the eighth position, and thereafter to the fourteenth position, and thereafter to the eighteenth position.

A typical alternate order of matching, for example for sixteen maximum number of the plurality and/or when the number of available (computer number selected) positions is sixteen, in order to occasionally place two cards consecutively in the same position, a matching order may be used such as 3-4-20-3 (may be utilized), as compared to the above-noted preferred order of 3-4-6-3 for sixteen positions.

There existed a problem previously noted above, of the inordinately large period of time required to shift back and forth between opposite ends of a linearly-aligned composite of, for example, sixteen positions when following a single sequence matching order and/or when proceeding to the next-occuring sequence of matching order (for the next four cards). This was overcome by the inventors bringing together opposite ends to have the plurality of positions arranged in a circle, as a wheel device; such also eliminated former requirements of having to physically change directions alternately back and forth, now being a continuously-revolving wheel.

It should be apparent that while the thus-far-illustrated matching orders are for four cards per sequence, four cards per matching-order sequence is merely preferred optimal and preferred for best or optimal randomizing. However, the number of cards fed per sequence may vary from sequence to sequence, and/or another number for each and every sequence may optionally be employed.

In the revolvable wheel, therefore, there are a plurality of card-receiving positions as above-described. At each of the plurality of positions, there is a structure and mechanism for grasping and pulling a card into a holding position, and for subsequently ejecting the card. Accordingly, at each position there is preferably a revolvable friction wheel as a part of the card-receiving position. The revolvable friction wheel includes a grasping surface that will grasp and move a card when the card is pressed thereagainst. Also, the card-receiving position includes a pressure structure and mechanism for pressing the card against the revolvable grasping surface of the revolvable friction wheel, such as a pressure plate biased by a spring element, one or more.

Likewise, the card holding and feeding structure and mechanism for each shoe card-container includes another revolvable friction wheel with grasping surface thereof, and an opposing pressure structure and mechanism thereof, such as other pressure plates and spring-biased springs thereof.

The card holding and feeding structure and mechanism includes at-least one shoe structure and operative mechanism thereof for inserting cards to be shuffled, feeding cards therefrom, and thereafter refeeding shuffled cards thereto. In a preferred embodiment however, while both shoe structures and mechanisms thereof may be identical, there are separate and different distinct feed and refeed (output) positions, normally referred to as input and output positions respectively. For optiomal operation and functioning, the preferred shoe structure includes a wheel-receiving space through a side thereof, such as an end-side positioned uprightly, through which the revolvable friction wheel for feeding cards, extends to contact a card pressed by the pressure plate in opposition to the revolvable friction wheel. The pressure plate and spring-biasing spring-structure thereof are mounted preferably within and as a part of the shoe structure. When the shoe structure is pushed into its feed position, the card is thereby pressed against the revolvable wheel's grasping surface. The shoe structure also includes one side panel thereof as a movable panel, typically and preferably slidable to open-up space from exterior to interior for the feeding or refeeding of card(s) therethrough, responsive to insertion of the shoe pushing the panel against an abutment.

Obviously the friction wheel and grasping surface is positioned to be oriented to effectively drive and feed a card toward and to a matched and aligned one of the plurality of wheel positions. Likewise the revolvable friction wheel and grasping surface thereof of each revolvable wheel's plurality of card-receiving positions, are positioned oriented to refeed output cards to a receiving shoe structure receivable of output shuffled cards, when matched and aligned therewith.

The revolvable friction wheel of the revolvable wheel structure of the plurality of positions, is mounted on and driven by preferably a revolvable shaft through a drive wheel mounted on a distant portion of the shaft, the drive wheel being positioned to engage a stationarily-mounted abutment structure which may be still another driven wheel driven or held stationary, as the need and case may be for a particular situation, to drive the friction wheel in the desired direction, i.e. in a grasping and pulling-in direction to pull a card into the holding position on the wheel structure or alternately to eject a card from its held position by driving the friction wheel in an opposite rotary direction. Where as noted above, there are separate feed (input) and refeed (output) positions, there will be separate abutments and/or abutting driving wheels/shafts, one set for imparting the grasping motion to the friction wheel grasping surface of the wheel structure of the plurality of positions, and another separate one for imparting the reverse ejection motion to the same friction wheel grasping surface of the wheel structure of the plurality of positions. The abutting element and/or wheel in each instance is moved into and out of contact preferably by solenoid action because of the speed, simplicity, durability and low cost and compactness thereof.

The computer mechanism of this invention includes computer software, programming software, for (1) holding area current (positions, of the plurality of wheel positions) for determining and setting positions (current) for a holding area number such that holding area start time is set, and (2) clock advance mechanism for advancing elapsed time clock by plus one millisecond, and (3) interrupting mechanism for locking-out of all interrupts to thereby initiate a stopping of drive motors, and to halt thereby all software functions, and to initiate a fault alarm. It must be understood that there is additionally much more software of a conventional computer nature employed in any computer and computer operation, including the present one, and it is not the purpose of this specification to expound on and list and describe every computer function and software and hardware necessary in a conventional manner for the computer employed as a part of this invention; for such matters, there is ample conventional art and literature and texts. Likewise, each and every conventional feature of the computer and its structure is not the essence of this invention, but composed of conventional computer elements and arrangements thereof. However, it is believed ample to state that the present computer includes hardware such as the noted card-receiving structure and mechanism thereof in-so-far-as it is tied-in with computer function, and the card-counters thereof and zero-setting elements and functions, and also variable mechanisms for initializing external switch variable settings, and interrupt mechanisms for implementing and for initializing software interrupts, and fault-responsive mechanisms for locking-out all interrupts and for stopping drive motors and for initiating external fault alarm, and input and output drives-elements and output card-feeds between said card first holding and feeding mechanism in-so-far-as computer control thereof is implemented, and the same for card-receiving mechanism and its control, and for the plurality's prevention mechanism for precluding the random-selection at all of predetermined ones of the plurality from being selected from time to time, and controls for setting a desired input and output current (positions) and for ascertaining the same, and for control of start motors and control of complete cycle initiation and control thereof, and for registering errors detected and sounding alarms and/or taking corrective steps by computer direction, and structure and elements for receiving and using desired and essential software in these and other matters.

Because it is of utmost importance that the persons playing black-jack card games be able to ascertain for themselves that there is no hanky-panky with the cards, i.e. that there is no foul-play, the cards being used in the game and then requiring shuffling, must be always kept visible to the players. Accordingly, the shoe(s) and the revolvable wheel structure carrying the plurality of positions, must each and both have a major portion of transparent and/or translucent glass or plastic or the like, making the cards always externally visible, i.e. visible from the outside of the shuffling machine and shoe(s) thereof.

As noted above, there is a preferred range of positions on the revolvable wheel structure, but larger numbers may be employed. However, more than eighteen result in thereupon having to have special miniature parts when there are too many positions, with the accompanying much greater and prohibitive costs of manufacture and maintenance thereof. Smaller numbers of positions than twelve result in too long a shuffling time.

However, it is possible to increase random and unpredictable shuffling capacity of the overall machine by computer programming the computer into believing there are larger numbers of positions, such as twenty positions—when in fact there are only sixteen (for example), and thereafter having the computer choose the appropriate matching order, but simultaneously eliminate four positions (such as the last four, for example) and apply the selected 20-position matching order to the sixteen positions as the revolvable wheel (and its plurality of positions) revolves a multiplicity of times.

Other such manipulations are possible and are within the scope of the present invention, using the same claimed structures of this invention, utilizable alternately by merely changing the computer chips (programming memory chips).

THE FIGURES

FIG. 1 is a diagrammatic representation of the non-computer structure of the shuffling machine of this invention, showing the revolvable wheel with its multiplicity of positions and the revolvable shafts and grasping wheel-surface of each for each position, and the drive mechanisms therefor, and the feed (input) and refeed (input) shoes and feed and refeed mechanisms thereof, and the like.

DETAILED DESCRIPTION

All Figures relate to the same embodiment diagrammatically illustrated to improve understanding and to point out preferred embodiments. Accordingly, for commonly illustrated parts or elements, identical indicia are found in different Figures.

Figure 1:
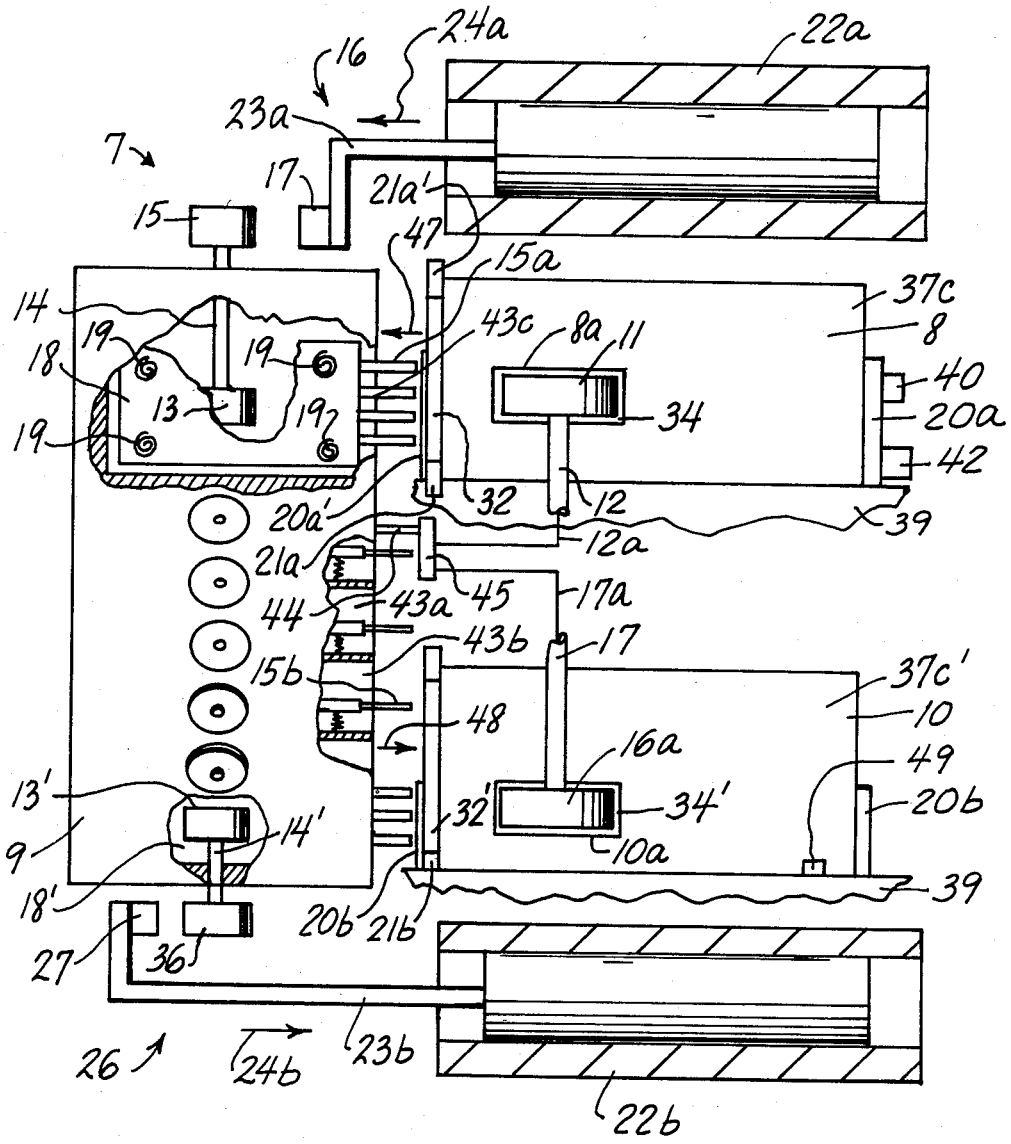

FIG. 1 illustrates diagrammatically the shuffling machine 7, except devoid of any illustration of obviously interconnected computer leads and switches, activation buttons, stop buttons, reset buttons, and the like. Basic components of the machine, aside from the computer, are the input shoe 8, the output shoe 10, and the revolvable wheel structure 9 having a plurality of open card-receiving and holding positions such as 43*a* and 43*b* and 43*c*. The wheel structure 9 revolves with shaft 44 driven by computer and electric motor 45, that also drives shafts 12 and 17 indirectly by appropriate connections 12*a* and 17*a*, such that shafts 12 and 17 drive respectively the shoe input feed wheel 11 and the shoe output feed wheel 16. The input wheel extends through shoe-side opening 10*a*, and the output wheel extends through shoe-side opening 10*a*.

Figure 2A:
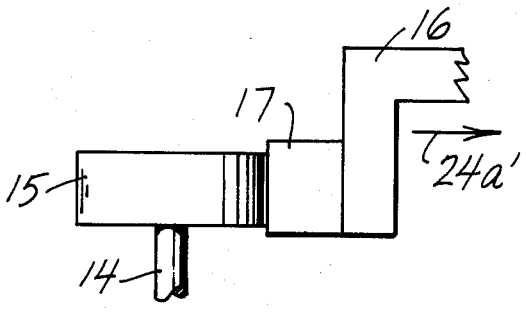
FIG. 2A illustrates diagrammatically an in-part view of the FIG. 1 embodiment during an activation, engagement and driving phase for the upper-represented position's driving revolvable shaft, for card(s) input from the shoe.
Figure 3A:
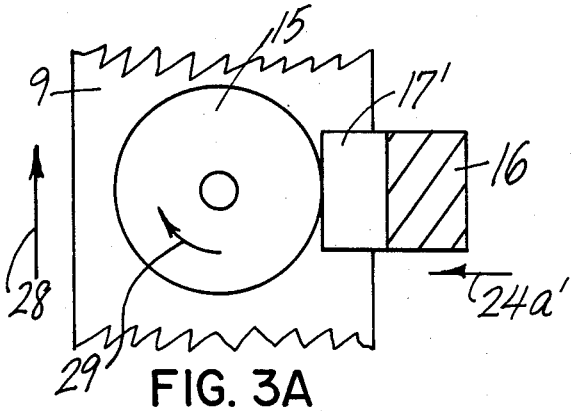
FIG. 3A illustrates diagrammatically a different view of the structure of FIG. 2A.
Figure 4:
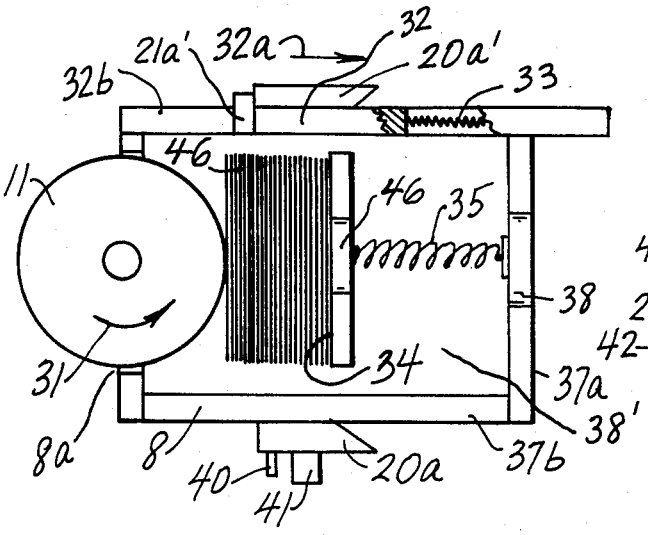
FIG. 4 illustrates a typical top view, diagrammatically, of the top, feed-input shoe, together with mounting structure and the drivable grasping surface of the wheel acting against cards in the shoe, ready for feed, in an in-part view of the embodiment of FIG. 1.

When activation on button/switch is turned to "on", the grasping surface of wheel 11 causes cards 46 (FIG. 4) to be fed one at a time toward and into a matched and aligned one of the positions such as position 43*c* to an extent and for a distance sufficient for the fed-card to be grasped by the position-retrieving grasping surface of wheel 13 that pulls the card to a position between the wheel 13 and the pressure plate 18. The pressure plate 18 is biased toward the wheel 13 by springs 19. The wheel 13 is driven intermittently by the revolvable shaft 14 when wheel 15 is caused to revolve as a result of abutment 17' coming into contact therewith as the wheel structure 9 continues to revolve as illustrated best in FIGS. 2A and 3A, when abutment-shaft 16 is driven as the shaft 23*a* moves forwardly in direction 24*a* when solenoid 22*a* is activated. To guide the card enroute from the input shoe to an aligned one of the positions, guide members 15*a* extend from the radially-extending pressure plate 18, facilitating and guiding a card moving in direction 47 from the input shoe 8.

The input shoe 8 after insertion of cards thereinto, is slid between supporting brackets 20*a* and 20*a'*. As it is inserted, a forward edge of a slidable wall 32 becomes engaged against an abutment barrier 21*a'* causing the slidable wall 32 to move in the direction 32*a* providing opening 32*b* through which one of the cards 46 is moved by action of the grasping wheel 11, as best viewable in FIG. 4. Biasing spring 33 (FIG. 4) normally closes slidable wall 32.

Figure 2B:
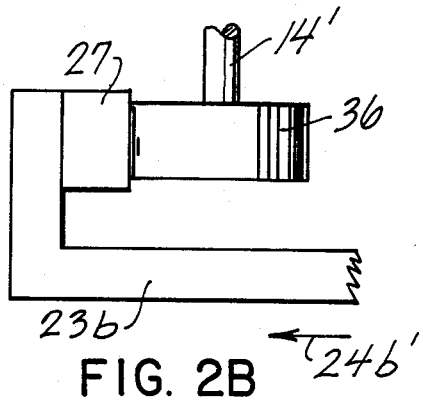
FIG. 2B illustrates diagrammatically an in-part view of the FIG. 1 embodiment during an activation, engagement and driving phase for the lower-represented position's driving revolvable shaft, for card(s) output to the shoe.
Figure 3B:
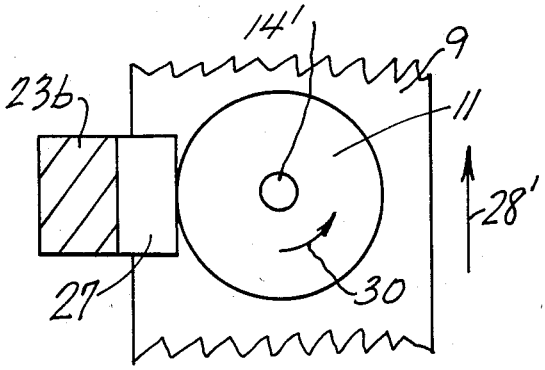
FIG. 3B illustrates diagrammatically a different view of structure of FIG. 2B.

In like manner, one or more cards, in accord with the computer programing, is fed (refed) by the reverse-direction action of the grasping surface of wheel 13' driven by shaft 14' when wheel 36 is engaged by abutment 27 moving in direction 24*b* by abutment shaft 26 when shaft 23*b* moves also in direction 24*b* upon activation of solenoid 22*b*; when the wheel 36 is thusly engaged, its direction of revolving movement is imparted by the continuing movement of the revolvable wheel structure 9 as is best illustrated in the FIGS. 2B and 3B in direction 30 on the shaft 14'. Thereby a card is moved in direction 48, toward shoe 10 to become engaged with and grasped by a grasping surface of output wheel 16*a* extending through the shoe opening (window) 10*a* and driven by the shaft 17. Shoe 10 is resting between guide brackets 20*b* and 20*b*'. Both shoes when resting in the inserted state are on the upper surface of table 39. Circuit-breaking switch 49 maintains a broken-circuit for the out-put cycle when shoe 10 is not inserted within its brackets 20*b* and 20*b*', preventing activation of solenoid 22*b* and thus preventing movement of abutment 27 in direction 24*b* against wheel 36; insertion of shoe 10 between brackets 20*b* and 20*b*' against switch 49 causes the circuit to be completed by closing circuit, such that when the computer then by its program activates this circuit, the output card is received into the output shoe 10 as pulled between the grasping surface of wheel 16*a* and the pressure plate 34' biased appropriate springs as already illustrated for the identical shoe 8, in FIG. 4. As for the insertion position for shoe 8, likewise the insertion position for shoe 10 also has an abutment barrier 21*b* causing the slidable wall 32' to move in a direction opening an open space through which the output card(s) is/are fed into the output shoe 10, the opening corresponding to the shoe 8 opening 32*b* viewable in FIG. 4. The shoes' wheel-windows are 8*a* and 10*a*.

Typical walls 37*a*, 37*b*, and 37*c* of shoe 8 are either transparent or transluscent, and likewise for the identical shoe 10 such as viewable wall (illustrated side/end wall) 37*c*' of shoe 10.

Figure 5:
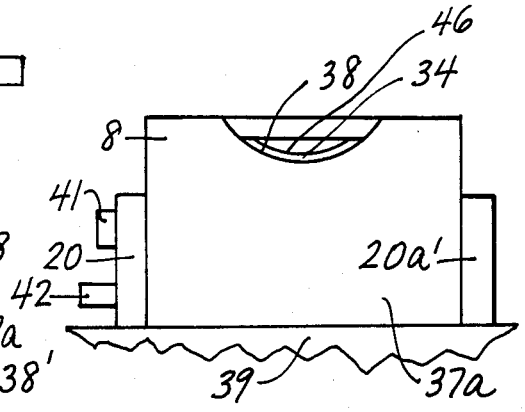
FIG. 5 illustrates diagrammatically an end view of the shoe and other structure illustrated in FIG. 4.

Each shoe has a depressed area such as 38 for the FIG. 5 illustrated shoe 8, making dealing of cards from the shoe easy for the dealer, when the shoe 8 is removed from its inserted state. Likewise there is depression 38' in the top of the pressure plate 34, for the same reason.

As is viewable in FIG. 3A, continuous and continued movement of wheel 9 in direction (revolving direction) 28 causes the wheel 15 to revolve in direction 29 when engaged with stationary abutment 17'. Likewise, as the revolvable wheel structure 9 revolves in direction 28, the oppositely-located abutment 27 (on an opposite side of drivable wheels of the respective positions) when engaged with the wheel 36 causes wheel 36 to revolve in direction 30 whereby the grasping surface of wheel 13' ejects a (any) card pressed against the wheel 13' by the corresponding pressure plate 18' (spring-biased), as shown in FIG. 3B. Also see FIGS. 2A and 3A.

Figure 6:
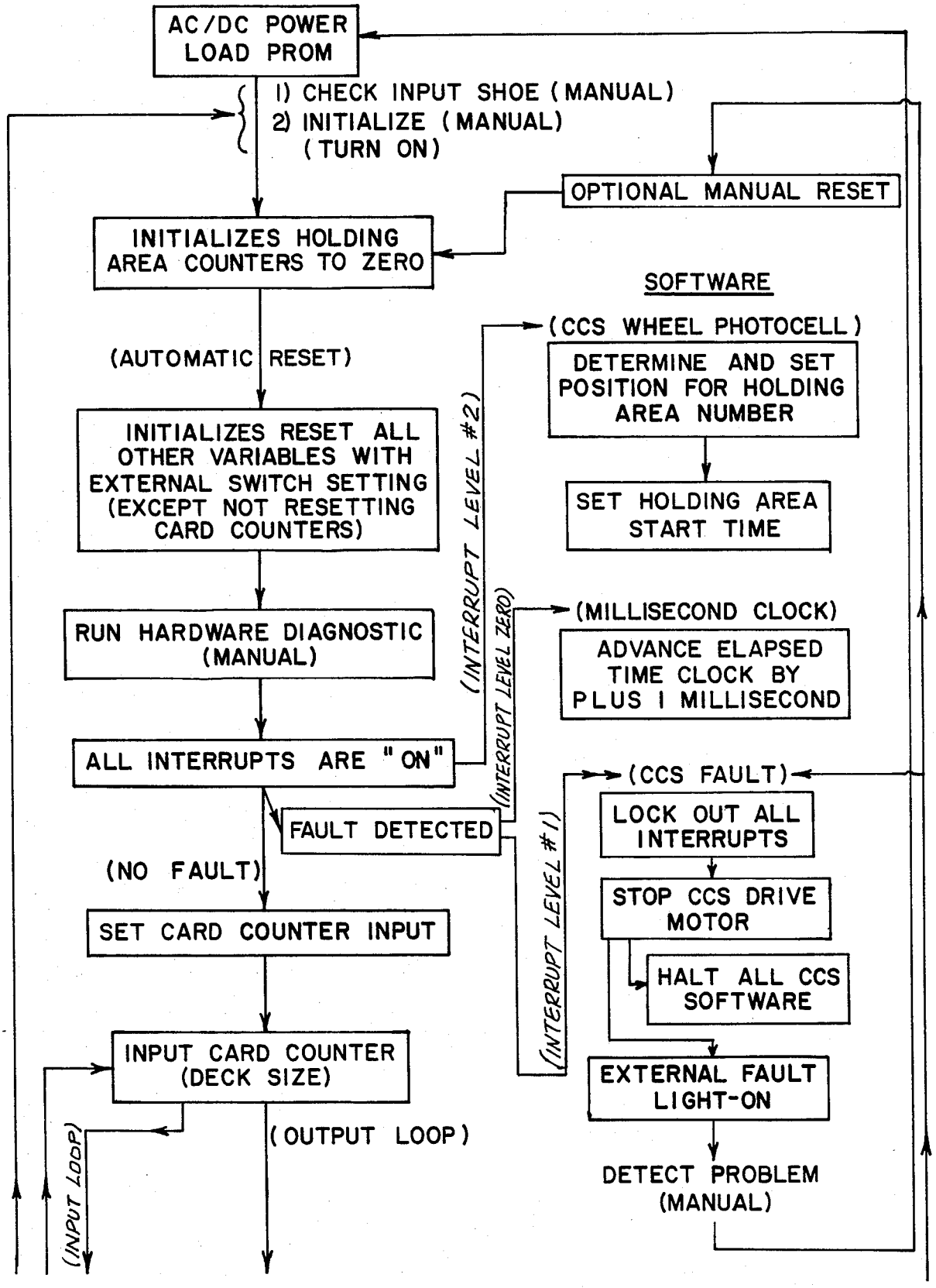
FIG. 6 is a large diagrammatic flow chart symbolically representative of the computer functions and procedural operation by way of each and both programmed and manual operation thereof, in the operation of the shuffling machine.
Figure 6:
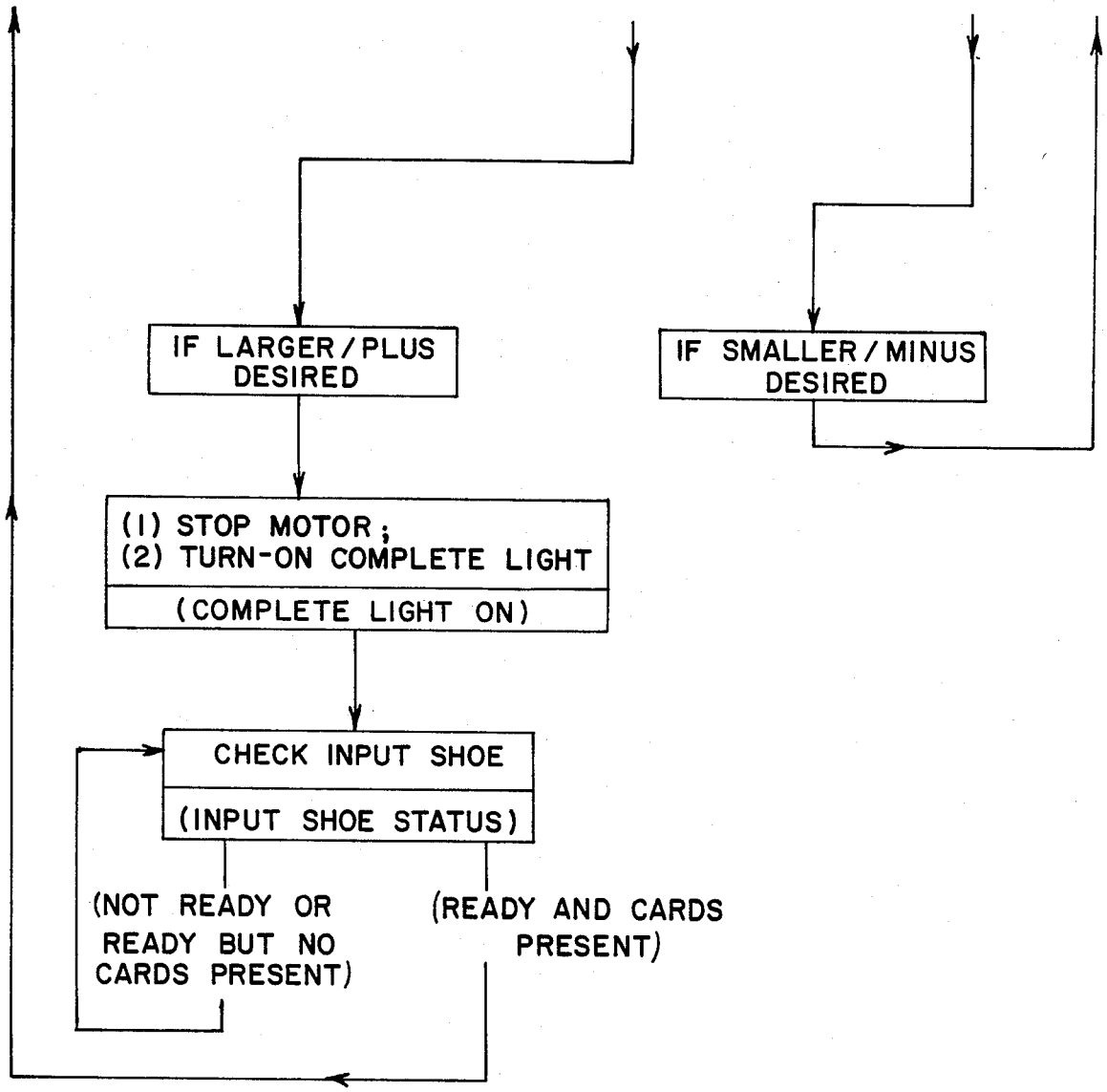
Figure 6:
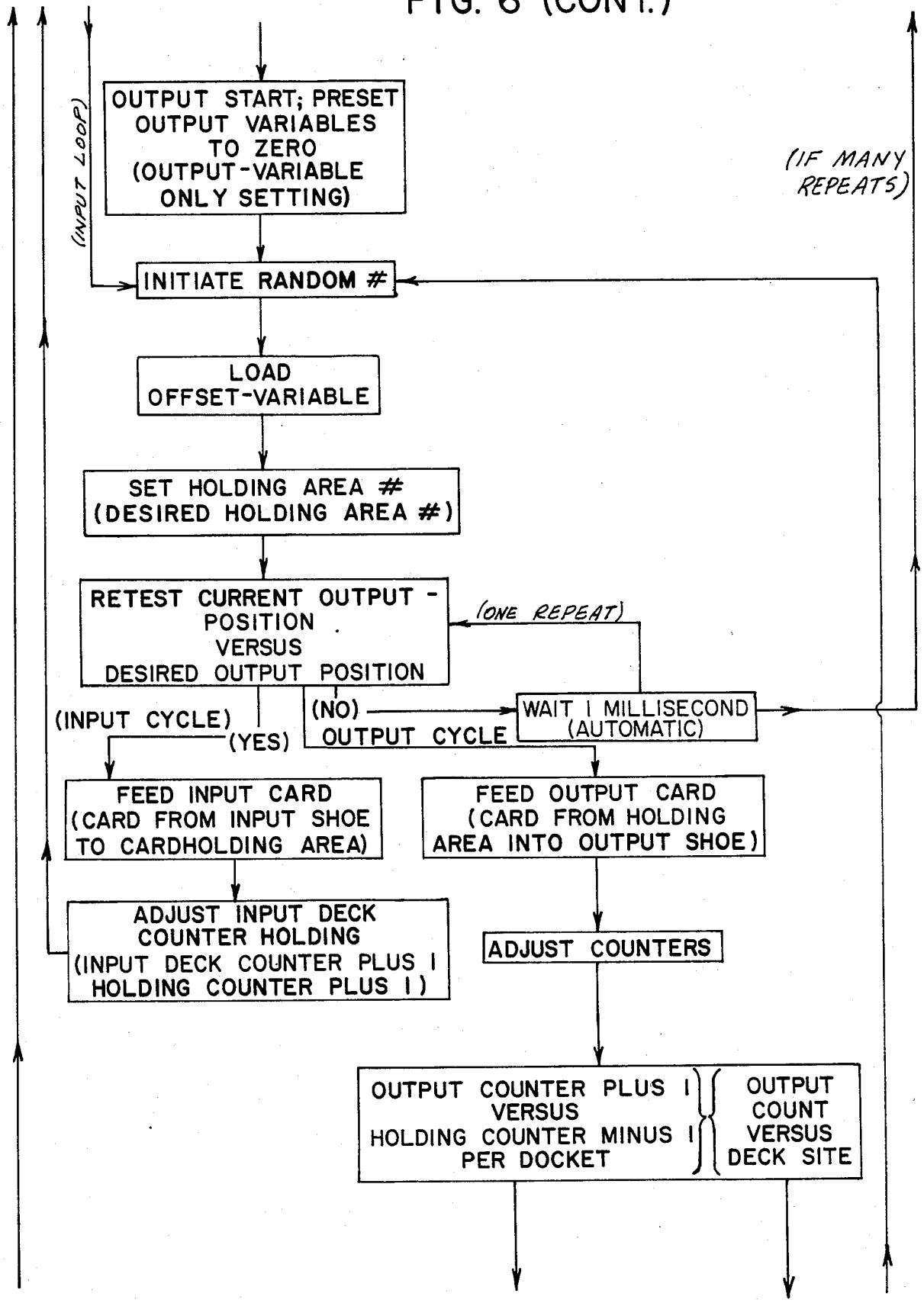

FIG. 6 is a diagrammatic flow chart typically representative of main functions of the computer and of hardware and software and operation thereof by a combination of programmed sequential instructions, intermingled with some manually-initiated instructions, and the like, and is not intended to illustrate all computer software and hardware and operator initiated instructions of a conventional nature not relating to the essence of this invention. The flow chart is believed to be substantially self explanatory.

Although separate instructions would be programmed and within the computer for separate input and output cycles, the flow chart for simplicity purposes combines into a single flow chart where functions and/or instructions and/or procedures are identical, diverging into separate flows when procedures differ, and the like.

It is within the scope of the invention to make various modifications in illustrated and/or claimed equipement where the purpose and function are substantially identical, and with programming memory chips and instructions thereof, which may vary considerably within the spirit and operation of the invention, for this shuffling machine.

There does not appear to be any relevant prior art, as based upon a pre-filing patentability search. While the main purpose of the present invention includes the random intermixing thoroughly and unpredictably of the cards to be shuffled and subsequently dealt, the U.S. Pat. No. 3,222,071 is directed to causing specific predetermined hands to be dealt to specific identified players—a completely opposite and unrelated concept and operation, of no relevance. The U.S. Pat. No. 3,589,730 is directed to a vertically-oriented cards-dividing apparatus as a totally different operation and equipement and result, even though having shuffling of cards as its purpose; there are no discernible teaching nor suggestions of any of the elements nor features of the present invention of the present specification and claims. Likewise, the apparatus of U.S. Pat. No. 3,588,116 operates and functions in much the same as the above-noted U.S. Pat. No. 3,589,730, having no discernible relevance to the present invention. U.S. Pat. No. 3,232,622, like above-noted U.S. Pat. No. 3,222,071, is directed to dealing for a particular game individual card hands to a specified number of players, dealing into separate wheel compartments of a revolvable wheel which stops by preselection at particular player-matched positions. The sole superficial similarity arises from use of a wheel having multiple positions, differently used for different function, and devoid of essentials of the present invention. U.S. Pat. No. 3,897,954 deals cards of one or more decks into a specified number of separate hoppers, and that is it; the selection of which cards go to which hopper is by a logic circuit. The apparatus, interfunctioning thereof, the sequential steps provided for, the mechanism of achieving the shuffling, and the like, and the shoes and the like employed, and objects (aside from mere intermixing of cards), are entirely separate, distinct and different for the present invention of the present specification and claims, not suggested nor taught by this U.S. Pat. No. 3,897,954. The U.S. Pat. No. 4,310,160 is a different card shuffling device substantially similar in approach to the above-noted U.S. Pat. Nos. 3,588,116 and 3,589,730.

I claim:

1. A computerized card shuffling device comprising in combination: a card holding and feeding means for holding a stack of cards and for feeding cards intermittently therefrom and thereto; a card transfer means including a plurality of card-receiving stations; and shifting means for intermittently randomly matching non-random sequences of said plurality of stations with said card holding and feeding means, the arrangement being such that when matched a card is feedable from the card holding and feeding means into a matched one of said plurality or alternately is feedable from a matched one of said plurality into said card holding and feeding means.

2. A computer card shuffling device of claim 1, in which each of (1) a shoe-portion of the card first-holding and feeding means and (2) a wheel-portion of the transfer means, is composed of major portions of transparent walls such that cards remain largely visible when stored in either or both the card first-holding and feeding means and the transfer means thereby being continuously viewable by both dealer and players during shuffling.

3. A computerized card shuffling device of claim 1, and initiation means for first causing said card holding and feeding means to intermittently feed one or more cards into different matched ones of said plurality of stations and for thereafter secondly intermittently causing different ones of said plurality to feed cards held by the plurality into said card holding and feeding means when intermittently different ones of the plurality are matched with the card holding and feeding means.

4. A computerized card shuffling device of claim 3, including selection means for causing different ones of said plurality to be intermittently matched in a predetermined non-random order of sequence of matching with said card first-holding and feeding means during feed of cards from the card holding and feeding means to intermittently matched ones of said plurality, and during feed of cards from intermittently matched ones of said plurality to said card holding and feeding means.

5. A computerized shuffling device of claim 4, in which said selection means provides intermittently in sequence different ones of said predetermined non-random order such that order of matching is intermittently continually changing during said feed from said card holding and feeding means to different ones of said plurality of stations and from different ones of said plurality of stations to said card holding and feeding means, the selection means including elements for said changing.

6. A computerized card shuffling device of claim 5, in which said selection means includes at least one of said predetermined non-random order that prevents at least one of said plurality from being matched with said card holding and feeding means during a sequence of the one which omits said at-least one of said plurality.

7. A computerized card shuffling device of claim 6, in which said selection means is further for randomly including said different ones of said predetermined non-random order such that there occur sequentially intermittently different randomly-selected orders of matching different ones of the the plurality to the card holding and feeding means.

8. A computerized card shuffling device of claim 5, in which said plurality of stations includes sixteen separate holding positions for holding cards fed from said card holding and feeding means.

9. A computerized card shuffling device of claim 8, in which when said predetermined order is selected to feed cards to all said sixteen separate holding positions, said predetermined order of matching is 3-4-6-3, such that a card is fed to a third one of said sixteen holding positions and thereafter to a seventh one of said sixteen holding positions and thereafter to a thirteenth of said sixteen holding positions and thereafter to a sixteenth of said sixteen holding positions for at least one sequence of the predetermined order prior to a next-occuring random selection of a predetermined order to follow.

10. A computerized card shuffling device of claim 8, in which when said predetermined order is selected to feed cards to only fifteen of said sixteen separate holding positions, said predetermined order of matching is 2-3-5-5 such that excluding the omitted position, a card is fed to a next-occuring second of said fifteen holding positions and thereafter to a fifth of said fifteen holding positions and thereafter to a tenth one of said fifteen holding positions and thereafter to an fifteenth of said fifteen holding positions for at-least one sequence of the predetermined order prior to a next-occuring random selection of a predetermined order to follow.

11. A computerized card shuffling device of claim 8, in which when said predetermined order is selected to feed cards to only fourteen of said sixteen holding positions, said predetermined order of matching is 2-6-3-3, such that excluding the omitted positions, a card is fed to a next-occuring second one of said fourteen holding positions and thereafter to a eighth one of said fourteen holding positions and thereafter to a eleventh one of said fourteen holding positions and thereafter to a fourteenth of said fourteen holding positions for at-least one sequence of the predetermined order prior to a next-occuring random selection of a predetermined order to follow.

12. A computerized card shuffling device of claim 8, in which when said predetermined order is selected to feed cards to only thirteen of said sixteen holding positions, said predetermined order of matching is 3-4-20-3 such that excluding the omitted positions, a card is fed to a next-occuring third one of said thirteen holding positions and thereafter to a seventh one of said thirteen holding positions and thereafter to a twenty-seventh of said thirteen holding positions and thereafter to a thirtieth of said thirteen holding positions for at-least one sequence of the predetermined order prior to a next-occuring random selection of a predetermined order to follow.

13. A computerized card shuffling device of claim 6, in which said plurality of stations is a number within a range of from fourteen to eighteen in which said at least one ranges up to six provided that remaining ones of said plurality of stations is at least twelve.

14. A computer card shuffling device of claim 13, in which a predetermined order of matching is based on twenty of said plurality of which sixteen are employed, in a basis of twenty matching order is 3-4-6-3.

15. A computer card shuffling device of claim 13, in which a predetermined order of matching is based on nineteen of said plurality of which sixteen are employed, in a basis of nine to matching order is 3-4-6-3.

16. A computerized card shuffling device of claim 13, in which when said predetermined order is selected to feed cards to only twelve of seventeen holding positions, said predetermined order of matching is 3-4-6-3, such that excluding the omitted positions, a card is fed to a next-occuring third one of said twelve holding positions and thereafter to a seventh one of said twelve holding positions and thereafter to a thirteenth one of said twelve holding positions and thereafter to a sixteenth one of said twelve holding positions for at-least one sequence of the predetermined order prior to a next-occuring random selection of a predetermined order to follow.

17. A computerized card shuffling device of claim 5, in which said predetermined order is selected to feed cards to sixteen separate holding positions, and for said sixteen separate holding positions said predetermined order of matching is 3-4-6-3 such that a card is fed to a third one of said sixteen holding positions and thereafter to a seventh one of said sixteen holding positions and thereafter to a thirteenth one of said sixteen holding positions and thereafter to a sixteenth of said sixteen holding positions for at least one sequence of the predetermined order prior to a next-occuring random selection of a predetermined order to follow.

18. A computerized card shuffling device of claim 5, in which said predetermined order is selected to feed cards to fifteen separate holding positions, and for said fifteen separate holding positions said predetermined order of matching is 2-3-5-5 such that a card is fed to a second one of said fifteen holding positions and thereafter to a fifth one of said fifteen holding positions and thereafter to a tenth one of said fifteen holding positions and thereafter to a fifteenth of said fifteen holding positions for at-least one sequence of the predetermined order prior to a next-occuring random selection of a predetermined order to follow.

19. A computerized card shuffling device of claim 5, in which said predetermined order is selected to feed cards to fourteen separate holding positions, and for said fourteen separate holding positions said predetermined order of matching is 2-6-3-3 such that a card is fed to a second one of said fourteen holding positions and thereafter to an eighth one of said fourteen holding positions and thereafter to an eleventh one of said fourteen holding positions and thereafter to a fourteenth one of said fourteen holding positions for at-least one sequence of the predetermined order prior to a next-occuring random selection of a predetermined order to follow.

20. A computerized card shuffling device of claim 5, in which said predetermined order is selected to feed cards to seventeen separate holding positions, for said seventeen separate holding positions said predetermined order of matching is 4-3-5-5 such that a card is fed to a fourth one of said seventeen holding positions and thereafter to a seventh one of said seventeen holding positions and thereafter to a twelth one of said seventeen holding positions and thereafter to a seventeenth one of said seventeen holding positions for at-least one sequence of the predetermined order prior to a next-occuring random selection of a predetermined order to follow.

21. A computerized card shuffling device of claim 5, in which said predetermined order is selected to feed cards to eighteen separate holding positions, for said eighteen separate holding positions said predetermined order of matching is 5-3-6-4 such that a card is fed to a fifth one of said eighteen holding positions and thereafter to a eighth one of said eighteen holding positions and thereafter to a fourteenth one of said eighteen holding positions and thereafter to an eighteenth one of said eighteen holding positions for at-least one sequence of the predetermined order prior to a next-occuring random selection of a predetermined order to follow.

22. A computerized card shuffling device of claim 1 or claim 9 or claim 11, in which said transfer means has said plurality of stations arranged as a revolvable wheel structure.

23. A computerized card shuffling device of claim 22, in which said transfer means includes a revolvable friction-wheel having a grasping surface movable first of a card when the revolvable friction-wheel is revolving and when concurrently the card is pressed thereagainst, and in which the revolvable friction-wheel further includes a pressure means for pressing said card against the revolvable friction-wheel.

24. A computerized card shuffling device of claim 23, in which each of said plurality of stations includes one of said revolvable friction-wheel and one of said pressure means.

25. A computerized card shuffling device of claim 23, in which said card holding and feeding means includes a revolvable second friction-wheel having a grasping surface movable of a card when the revolvable second friction-wheel is revolving and when concurrently the card is pressed thereagainst, and in which the revolvable second friction-wheel further includes a second pressue means for pressing a card against the revolvable second friction-wheel.

26. A computerized card shuffling device of claim 25, in which said card holding and feeding means includes a shoe-structure that includes wheel-receiving space through which said revolvable second friction-wheel extends to contact a card pressed by said second pressure means when said holding and feeding means is positioned in juxtaposition to said transfer means such that intermittently one of said plurality is matchable and alignable with the card holding and feeding means.

27. A computerized card shuffling device of claim 26, in which said card holding and feeding means includes two separate ones of said shoe-structure as first and second shoes, the first shoe being adapted to feed cards to said card receiving means, and the second shoe being adapted to receive cards fed from said transfer means.

28. A computerized card shuffling device of claim 26 and claim 1, in which said shifting means includes a light and an associated photoelectric cell mounted on at least one of said card holding and feeding means and said transfer means, and light blocking and non-blocking structure for selectively blocking and not-blocking light between said light and said associated photoelectric cell, mounted on a remaining other one of said card holding and feeding means and said transfer means such that and adapted for timing intermittently separate ones of said plurality of stations to be aligned and matched with said card holding and feeding means and any matched one of said plurality of stations.

29. A computerized card shuffling device of claim 22, in which said transfer means includes a first revolving structure adapted for revolvably supporting said revolvable wheel structure around a first axis in a revolving motion along a first plane, and said first receiving means further including a first drive means revolvably drivable of said revolvable wheel structure, and said card holding and feeding means including a second drive means causing cards to be intermittently fed between said card first-holding and feeding means and matched and aligned ones of said plurality, and third drive means for causing said plurality to intermittently feed cards between said card holding and feeding means and matched and aligned ones of said plurality.

30. A computerized card shuffling device of claim 29, in which the receiving means includes as a third drive means, the revolvable second friction-wheel, said revolvable friction-wheel being revolvable around a second revolvable shaft, and said card holding and feeding means including an abutment means for intermittently becoming engaged with said revolvable shaft such that movement revolvably of said revolvable wheel structure causes said revolvable shaft to revolve when in contact with the abutment means.

31. A computerized card shuffling device of claim 30, in which each of said plurality includes a separate said revolvable second friction-wheel and revolvable shaft thereof, with the abutment means being positioned such that the revolvable friction-wheel of each of said plurality revolves when the one of the plurality corresponding to the revolving revolvable friction wheel is matched and aligned with said card holding and feeding means.

32. A computerized card shuffling device of claim 31, in which there are two separate spaced-apart ones of said abutment means and two separate spaced-apart ones of said card holding and feeding means, as first and second abutment means and as first and second card holding and feeding means, the first abutment means being adapted to cause cards to feed to an aligned one of said plurality from said first card holding and feeding means, and to cause cards to feed from an aligned one of said plurality to said second card holding and feeding means.

33. A computerized card shuffling device of claim 32, in which each of said first and second card holding and feeding means includes a shoe vessel having a top opening sufficiently large for a dealer to deal a vessel-contained card therefrom, and having a spring-biased movable side movable when pressed against an abutment, and having space provided through an end of the shoe sufficiently large for passage therethrough of said second friction-wheel, and a shoe-door-abutting element in juxtaposition and opposing relationship to said spring-biased movable side movable door positioned to cause said side movable door to be moved sufficiently to provide necessary opening space for movement therethrough of a card by said second friction-wheel, for each shoe vessel.

34. A computerized card shuffling device of claim 31, in which said abutment means comprises a wheel-abutting element movable intermittently alternately into contact with and away from contact with a matched one of said revolvable friction-wheel, and said abutment means further including a solenoid means for intermittently moving said wheel-abutting element alternately into contact with and away from contact with a matched one of said revolvable friction-wheel.

35. A computerized card shuffling device of claims 4 and 5, in which said selection means comprises a computer programmed to include a random number as said predetermined order of sequence of matching.

36. A computerized card shuffling device of claim 35, in which said computer includes programming software (1) holding area current means for determining and setting current for holding area number such that holding area start time is set, and (2) clock advance means for advancing elapsed time clock by plus one millisecond, and (3) interrupt means for locking-out all interrupts to thereby initiate a stopping of drive motors, and to halt thereby all software functions, and to initiate a fault-alarm.

37. A computer card shuffling device of claim 4, in which said selection means comprises a computer that includes hardware comprising transfer means card-counter and zero-setting elements, card holding and feeding means card-counter and zero-further-setting elements, variable means for initializing external switch variable settings, interrupt means for implementing and for initializing software interrupts, fault-responsive means for locking-out all interrupts and for stopping drive motors and for initiating external fault alarm, input and output drives-elements and reversal means for setting and ascertaining direction of input and output card-feeds between said card holding and feeding means and any one of said plurality of stations, and plurality-prevention means for preventing random-selected predetermined ones of said plurality from being included in at-least one cycle of predetermined order of which said plurality shall be fed a card or from which a card will be delivered during the next-occuring randomly-selected sequence, means for setting desired input and output currents and for ascertaining the same, start motors means and complete-cycle means and light and operational elements thereof, error-detecting means for ascertaining incorrectly positioned or malfunctioning card holding and feeding means, and means for receiving software programming, and action thereon.

* * * * *